US009517649B2

(12) United States Patent
Decker

(10) Patent No.: US 9,517,649 B2
(45) Date of Patent: Dec. 13, 2016

(54) APPARATUS FOR STAMPING BELTS

(71) Applicant: Dannie Decker, Old Fort, TN (US)

(72) Inventor: Dannie Decker, Old Fort, TN (US)

(73) Assignee: Dannie Decker, Old Fort, TN (US)

( * ) Notice: Subject to any disclaimer, the term of this patent is extended or adjusted under 35 U.S.C. 154(b) by 0 days.

(21) Appl. No.: 14/863,619

(22) Filed: Sep. 24, 2015

(65) Prior Publication Data

US 2016/0082759 A1 Mar. 24, 2016

Related U.S. Application Data

(60) Provisional application No. 62/054,659, filed on Sep. 24, 2014.

(51) Int. Cl.

| | |
|---|---|
| ***B41K 3/02*** | (2006.01) |
| ***B41K 3/44*** | (2006.01) |
| ***A41F 9/00*** | (2006.01) |
| ***C14B 1/56*** | (2006.01) |
| *B44B 5/02* | (2006.01) |

(52) U.S. Cl.

CPC ..... *B41K 3/44* (2013.01); *A41F 9/002* (2013.01); *C14B 1/56* (2013.01); *B44B 5/022* (2013.01)

(58) Field of Classification Search

CPC ..... B41K 3/44; B41K 3/36; B41K 3/40; B41K 3/02; B44B 5/026; B44B 5/022; B44B 7/02; A41F 9/002; B43L 13/205; B43L 13/201; B43L 13/208; B43L 13/203; B41F 17/08; B41F 17/10; B41F 17/14; B41F 17/20

USPC ..... 101/35, 41, 369, 371; 33/562, 564, 565, 33/566; 408/115 R

See application file for complete search history.

(56) References Cited

U.S. PATENT DOCUMENTS

| | | | | |
|---|---|---|---|---|
| 3,584,385 A * | 6/1971 | Booth | B43L 13/208 | 101/128 |
| 4,537,128 A * | 8/1985 | Burroughs | B41K 1/00 | 101/102 |
| 4,742,771 A * | 5/1988 | Heilig | B07C 3/18 | 101/103 |
| 5,394,799 A * | 3/1995 | Rhodes | B41L 19/00 | 101/269 |
| 5,694,855 A * | 12/1997 | Gardner | B41K 3/46 | 101/407.1 |
| 7,241,091 B1 * | 7/2007 | Yang | B27F 5/12 | 144/136.95 |

* cited by examiner

*Primary Examiner* — Leslie J Evanisko

(57) ABSTRACT

A device for imprinting a leather belt or other comparable accessory contains a structural body and a longitudinal cavity. The belt is held in place by a central panel, a first rail, and a second rail of the structural body. More specifically, the belt is held stationary in a belt receiving channel which is delineated by a surface of the central panel, the first rail, and the second rail. When the belt is held stationary, the longitudinal cavity is used to imprint a stamp on the belt. In doing so, a stamp body which contains a preferred stamp is positioned in the longitudinal cavity and struck with a mallet or similar device which can produce a considerable force. Since the belt receiving channel is accessible through the longitudinal cavity, the stamp is imprinted on the belt with minimum effort.

17 Claims, 8 Drawing Sheets

APPARATUS FOR STAMPING BELTS

The current application claims a priority to the U.S. Provisional Patent application Ser. No. 62/054,659 filed on Sep. 24, 2014.

FIELD OF THE INVENTION

The present invention relates generally to an apparatus to be used along with a belt. More specifically, the present invention that can be used in the process of stamping a belt or other similar products.

BACKGROUND OF THE INVENTION

Leather wholesale suppliers supply consumers with leather belt blanks that can be stamped to create an original, or specialized, finished product. These same suppliers also wholesale to consumers, leather stamps featuring both capital and lower case letters, as well as many different variations of art and design that are used in creating a finished leather belt product. Originally, these stamps were designed to be used in conjunction with a conventional mallet or hammer, with no aid or guide to keep these stamps straight and level while decorating the belt. Users with no aid or guide were often left having to strike tile stamp a second time, resulting in a double impression on the leather.

To date, however, there has been no producer of an aid or device for custom leather stamping. For someone who desires professional craftsmanship, a double impression caused by a misaligned stamp is unacceptable. Thus, if the leather stamp could have been placed in a device, the misalignment of the letters and character stamps would cease. There would be no more leather belt blanks wasted due to double line impressions caused by off-centered and/or crooked leather stamps.

The present invention is a device for the stamping of leather used to create belts or similar leather products. When a guide for the stamp is used, the belt blank stamping surface becomes straight, taking the guesswork out of the placement of the stamps. Also, when an area of the belt has been sufficiently stamped, the aid can be slid down the belt, resulting in a new stamping area that is merely a continuation of the previous work area. This aid results in the elimination of any extra effort needed to ensure that the new stamping area is aligned with the previously stamped area.

This guide also features a notch on the underside and topside area, located in the center, which allows the user to align the guide with the center of the belt blank. This notch is used to ensure that the work to be done or the leather to be stamped is correctly centered; resulting in a more professional looking finished product.

DETAIL DESCRIPTIONS OF THE INVENTION

All illustrations of the drawings are for the purpose of describing selected versions of the present invention and are not intended to limit the scope of the present invention.

The present invention introduces an apparatus that can be used to stamp a belt or other comparable accessory which is preferably made of leather or a similar material. By utilizing the present invention, which acts as a guide for stamping, the user is guaranteed to achieve results which are of professional quality. In particular, the use of the present invention reduces the probability of having misaligned stamps which can usually lead to unattractive results.

Figure 1:
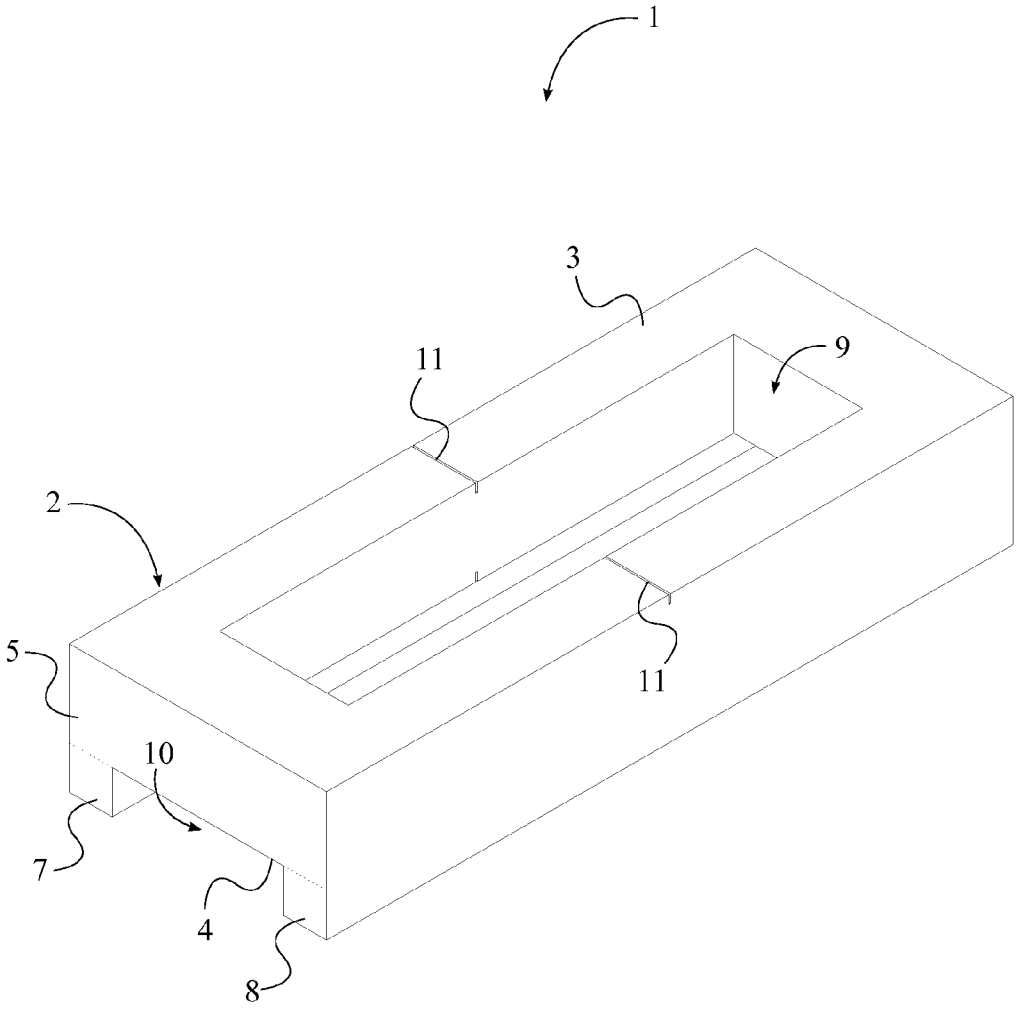
FIG. 1 is a perspective view of the present invention.
Figure 2:
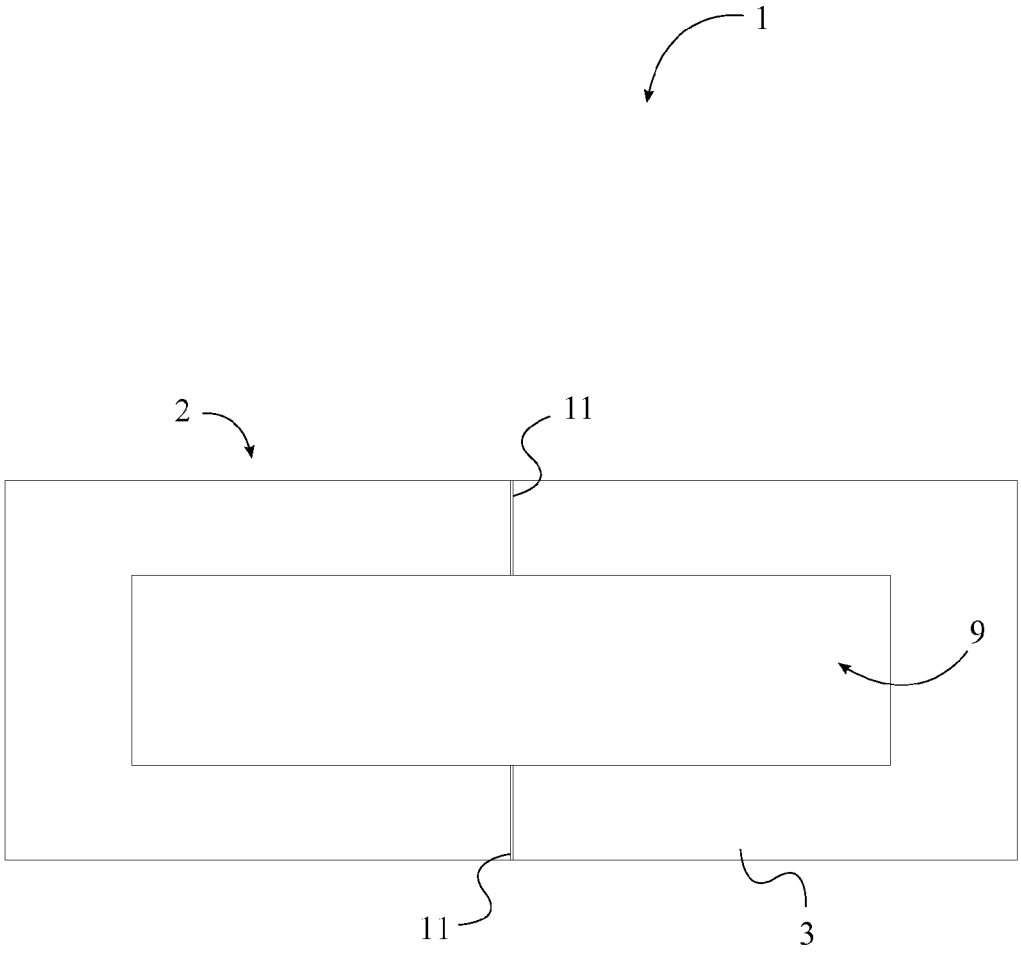
FIG. 2 is a top view of the present invention.
Figure 3:
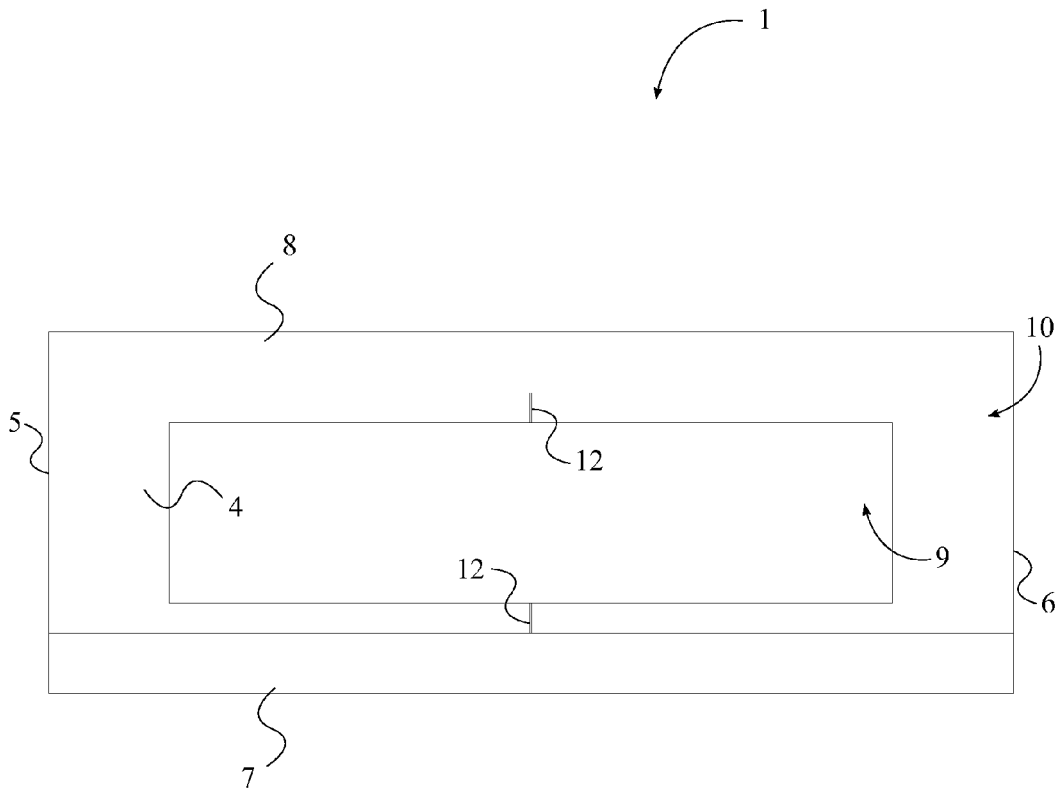
FIG. 3 is a bottom view of the present invention.
Figure 4:
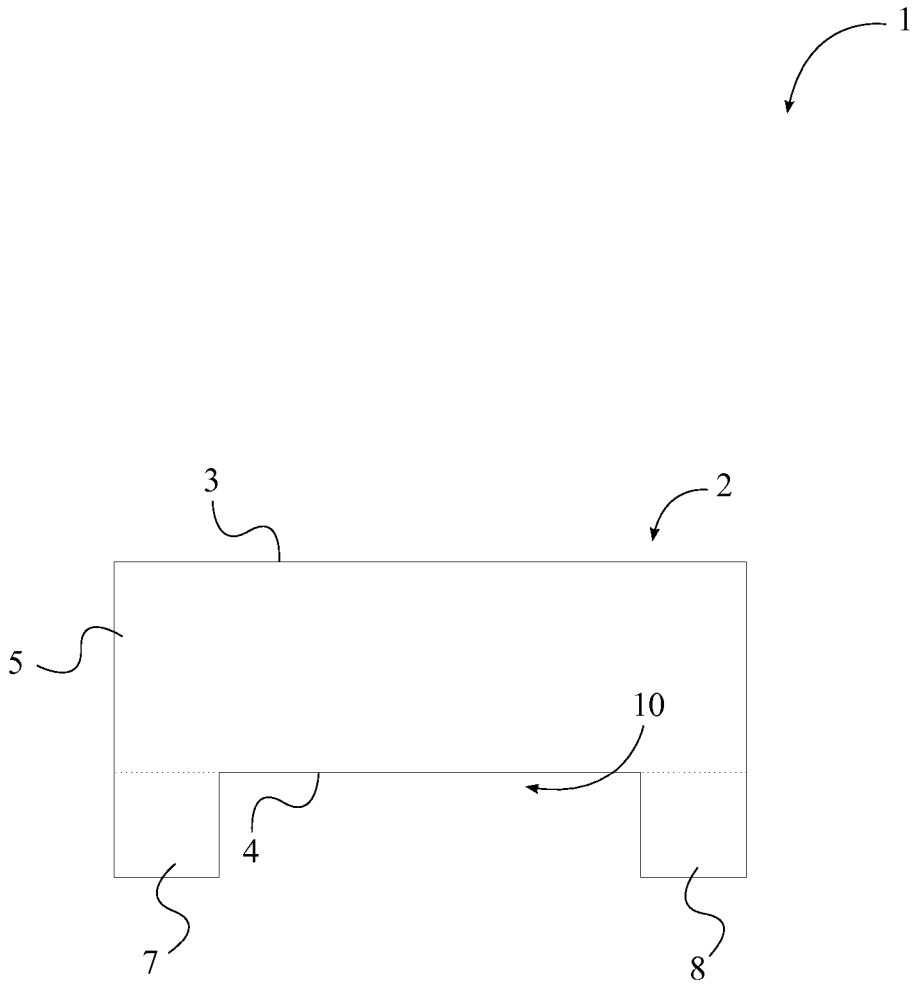
FIG. 4 is a side view of the present invention.
Figure 5:
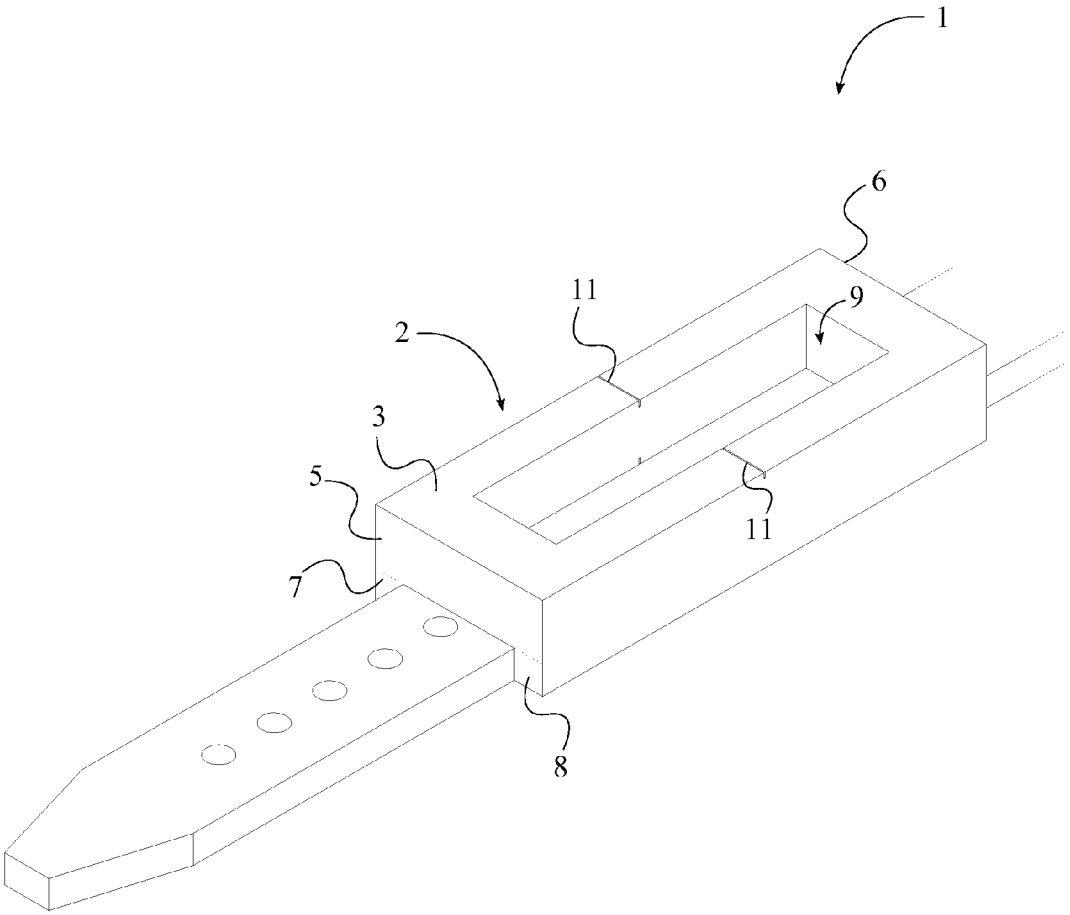
FIG. 5 is a perspective view of the present invention, wherein the belt is positioned in between the first rail and the second rail.
Figure 6:
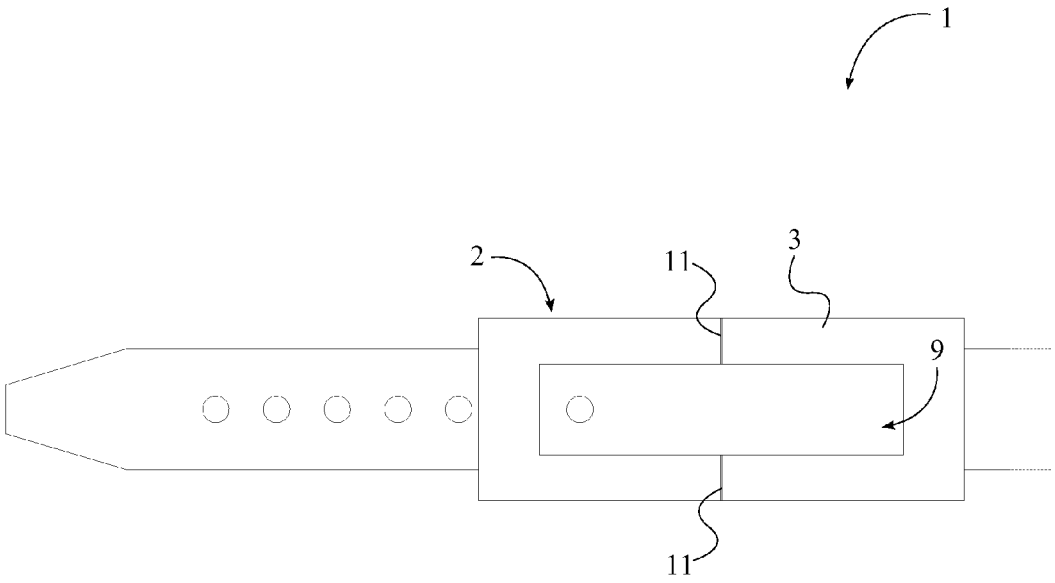
FIG. 6 is a top view of the present invention, wherein the belt is positioned in between the first rail and the second rail.
Figure 7:
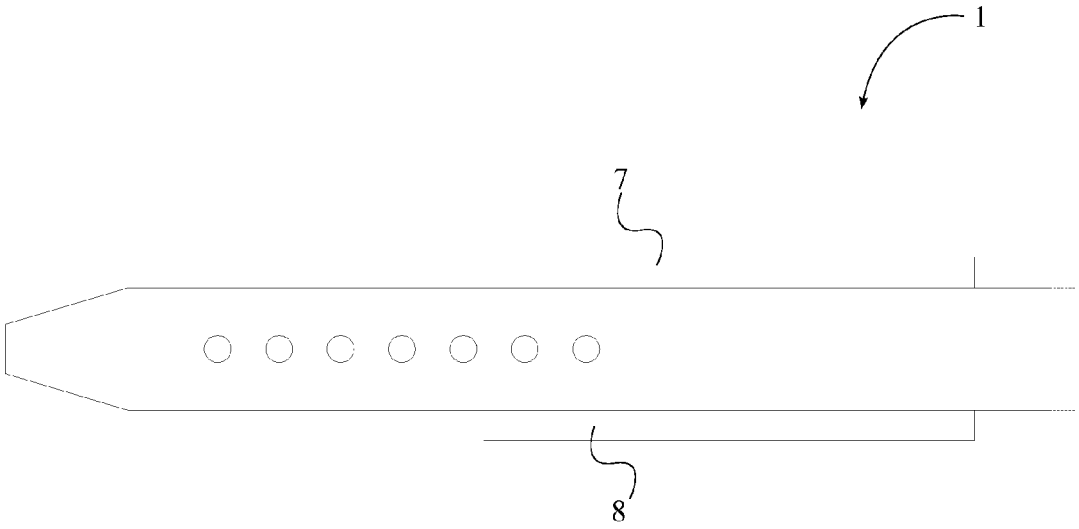
FIG. 7 is a bottom view of the present invention, wherein the belt is positioned in between the first rail and the second rail.
Figure 8:
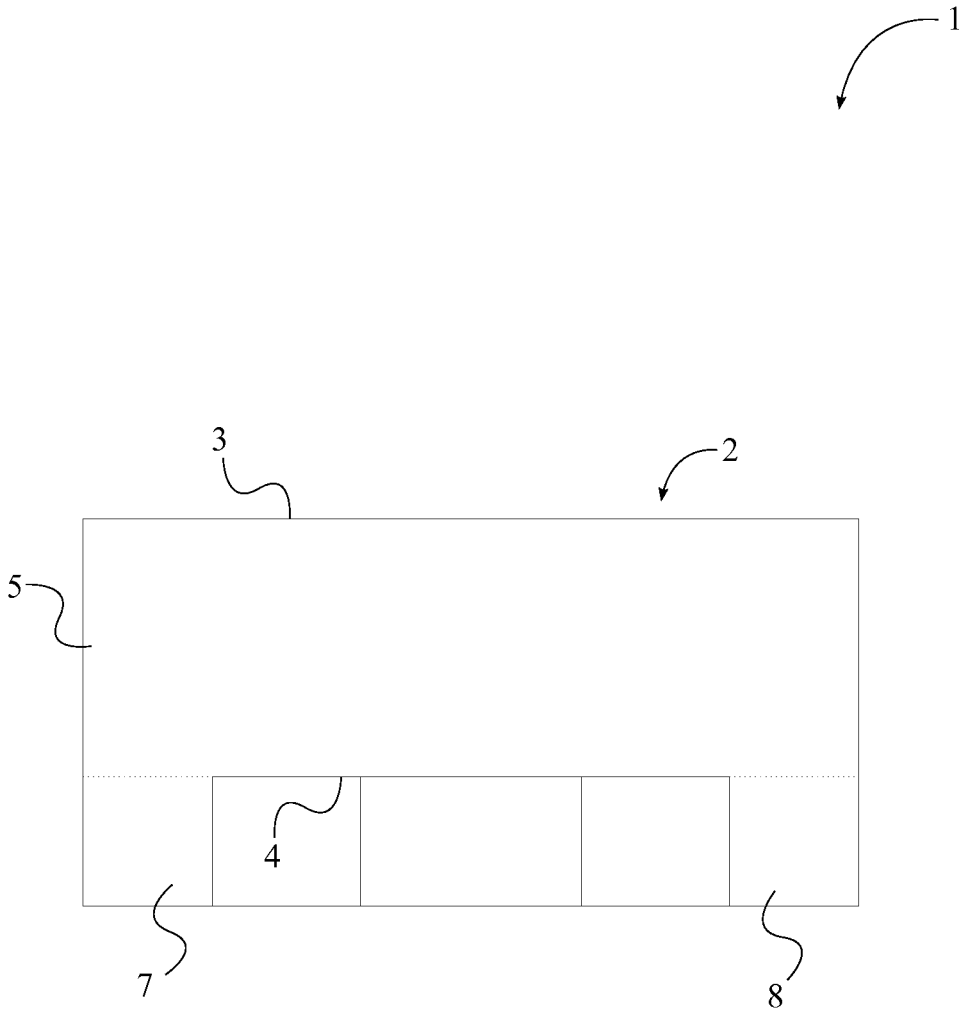
FIG. 8 is a side view of the present invention, wherein the belt is positioned in between the first rail and the second rail.

As illustrated in FIGS. 1-3, the present invention comprises a structural body 1 and a longitudinal cavity 9. The structural body 1 is utilized to keep the belt or comparable accessory stationary during the stamping process. In the preferred embodiment of the present invention, the structural body is designed as a single block. However, in other embodiments of the present invention, the structural body can be designed to extend in lengthwise directions and widthwise directions such that the present invention can be used to imprint on different sized products. The longitudinal cavity 9 enables the user to access the belt which is held by the structural body 1. In the preferred embodiment of the present invention, the longitudinal cavity 9 is rectangular in shape. The longitudinal cavity 9 is sufficiently sized to accommodate a stamp body. The structural body 1, which can be made of wood or other comparable lightweight material, comprises a central panel 2, a first rail 7, and a second rail 8. The central panel 2 in the preferred embodiment of the present invention is rectangular in shape and comprises a first surface 3 and a second surface 4. However, the shape and size of the central panel 2 can vary in other embodiments of the present invention. When the present invention is being used, the belt is placed in a belt receiving channel 10 which is delineated by the second surface 4, the first rail 7, and the second rail 8. In order to create the belt receiving channel 10, the first rail 7 and the second rail 8 are adjacently connected to the second surface 4 as seen in FIG. 4. Moreover, the first rail 7 and the second rail 8 are positioned perpendicular to the second surface 4 such that the belt can be conveniently placed in the belt receiving channel 10. In order to secure the belt within the belt receiving channel 10 and also to accommodate a wide variety of belts, the first rail 7 and the second rail 8 are positioned opposite to each other across the central panel 2. In particular, the first rail 7 and the second rail 8 are sufficiently distanced such that a variety of belts can comfortably fit in between the first rail 7 and the second rail 8. The perpendicular positioning of the first rail 7 and the second rail 8 ensures that the belt lies flush against the second surface 4 during the stamping process. The first rail 7 is symmetrical to the second rail 8. Therefore, when the belt is placed in the belt receiving channel 10 while the structural body 1 rests on the first rail 7 and the second rail 8, the stamp can be imprinted on the belt with minimum effort. When the belt is placed in the belt receiving channel 10, the belt is stamped with a preferred font through the longitudinal cavity 9. In order to do so, the longitudinal cavity 9 perpendicularly traverses through the central panel 2 from the first surface 3 to the second surface 4. However, in another embodiment of the present invention, the longitudinal cavity 9 can be tapered inwards, such that the opening at the first surface 3 is wider than the opening at the second surface 4. The tapered configuration is beneficial if the user intends on using stamp bodies of different sizes. Regardless of the shape of the longitudinal cavity 9, the positioning of the longitudinal cavity 9 allows the user to directly reach the belt which is positioned in the belt receiving channel 10. The longitudinal cavity 9 and the belt receiving channel 10 are positioned in parallel to each other such that the stamping process can be completed by having the structural body 1 stationary throughout the process. Since the belt receiving channel 10 is in between the first rail 7 and the second rail 8, the longitudinal cavity 9 is also positioned in parallel to the first rail 7 and the second rail 8. Additionally, the first rail 7 and the second rail 8 are positioned along the central panel 2. Therefore, a considerable length of the belt can be stamped with minimum movement to the structural body 1.

As seen in FIG. 3, the central panel 2 further comprises a first lateral surface 5 and a second lateral surface 6. The first lateral surface 5 and the second lateral surface 6 is positioned opposite to each other and along the central panel 2. In the preferred embodiment of the present invention, a height of the first lateral surface 5 and a height of the second lateral surface 6 determine the height of the central panel 2. Moreover, the first lateral surface 5 and the second lateral surface 6 are perpendicular to the first surface 3 and the second surface 4. In other words, if the first surface 3 and the second surface 4 is considered a top surface and a bottom surface of the central panel 2, the first lateral surface 5 and the second lateral surface 6 is considered to be a left side surface and a right side surface of the central panel 2.

As illustrated in FIGS. 5-8, when the present invention is being used along with a belt, the belt is positioned in the belt receiving channel 10 in between the first rail 7 and the second rail 8. In order to insert the belt into the belt receiving channel 10 and to slide the belt along the belt receiving channel 10, the structural body 1 requires two corresponding open ends. In order to provide the two open ends, the belt receiving channel 10 extends from the first lateral surface 5 to the second lateral surface 6. As a result, the user is allowed to continuously imprint the belt by sliding the belt through the belt receiving channel 10. However, in order to have the structural body 1 as one piece, the longitudinal cavity 9 does not extend from the first lateral surface 5 to the second lateral surface 6. More specifically, the longitudinal cavity 9 is positioned in between the first lateral surface 5 and the second lateral surface 6.

As seen in FIG. 2, the present invention comprises a first plurality of alignment grooves 11 which is used for aligning purposes during the stamping process. More specifically, the first plurality of alignment grooves 11 is utilized to align the stamp body of a desired stamp. As a result, the user is guaranteed to maintain a uniform distance between each of the stamped imprints. In order to do so, the first plurality of alignment grooves 11 is centrally positioned on the first surface 3 such that each of the first plurality of alignment grooves 11 is positioned perpendicular to the longitudinal cavity 9. As seen in FIG. 3, the present invention further comprises a second plurality of alignment grooves 12 which is centrally positioned on the second surface 4. Similar to the first plurality of alignment grooves 11, the second plurality of alignment grooves 12 is also positioned perpendicular to the longitudinal cavity 9. The first surface 3 is identical to the second surface 4. Therefore, when the first plurality of alignment grooves 11 is centrally positioned on the first surface 3 and the second plurality of alignment grooves 12 is centrally positioned on the second surface 4, the first plurality of alignment grooves 11 is aligned with the second plurality of alignment grooves 12. In another embodiment of the present invention, the first plurality of alignment grooves 11 and the second plurality of alignment grooves 12 can be represented as a measuring ruler such that the user can conveniently space out the stamps that are to be imprinted on the belt. By utilizing the first plurality of alignment grooves 11 and the second plurality of alignment grooves 12, the user is allowed to complete the stamping process with uniformly spaced imprints.

When utilizing the present invention, the following process flow can be followed. As a first step, the belt which requires an imprint is inserted into the belt receiving channel 10. When the belt is inserted, the belt is secured in place with the second surface 4, the first rail 7, and the second rail 8. Next, the stamp body with the preferred stamp is placed in the longitudinal cavity 9. The stamp body is aligned according to user preference by utilizing either the first plurality of alignment grooves 11 or the second plurality of alignment grooves 12. When the alignment process is completed, the user strikes the stamp body with a mallet or similar device such that the stamp is imprinted on the belt. The procedure is repeated until the desired results are imprinted on the belt. The belt is slid through the belt receiving channel 10 in order to imprint the stamp on different locations along the length of the belt.

Although the invention has been explained in relation to its preferred embodiment, it is to be understood that many other possible modifications and variations can be made without departing from the spirit and scope of the invention as hereinafter claimed.

What is claimed is:

1. A device for stamping on a belt comprises:

a structural body;

a longitudinal cavity;

the structural body comprises a central panel, a first rail, and a second rail;

the central panel comprises a first surface and a second surface;

the first rail and the second rail being adjacently connected to the second surface;

the first rail and the second rail being positioned perpendicular to the second surface;

the first rail and the second rail being positioned opposite each other across the central panel;

the longitudinal cavity traversing through and being tapered inwards the central panel from the first surface to the second surface, the longitudinal cavity having a first opening formed on the first surface and a second opening formed on the second surface and narrower than the first opening;

the second surface, the first rail, and the second rail delineating a belt receiving channel;

the longitudinal cavity and the belt receiving channel being positioned in parallel to each other;

the first rail and the second rail being positioned along the central panel;

at least one first alignment groove centrally positioned on the first surface and directly communicated with the longitudinal cavity;

at least one second alignment groove centrally positioned on the second surface and directly communicated with the longitudinal cavity; and the at least one first alignment groove and the at least one second alignment groove being aligned with each other.

2. The device for stamping on a belt as claimed in claim 1 comprises:

the central panel further comprises a first lateral surface and a second lateral surface;

the first lateral surface and the second lateral surface being positioned opposite to each other along the central panel; and the first lateral surface and the second lateral surface being perpendicular to the first surface and the second surface.

3. The device for stamping on a belt as claimed in claim 2, wherein the belt receiving channel being extended from the first lateral surface to the second lateral surface.

4. The device for stamping on a belt as claimed in claim 2, wherein the longitudinal cavity being positioned in between the first lateral surface and the second lateral surface.

5. The device for stamping on a belt as claimed in claim 1, wherein the first rail is symmetrical to the second rail.

6. The device for stamping on a belt as claimed in claim 1 comprises:

a plurality of first alignment grooves;

the plurality of first alignment grooves being centrally positioned on the first surface; and each of the plurality of first alignment grooves being positioned perpendicular to the longitudinal cavity.

7. The device for stamping on a belt as claimed in claim 1 comprises:

a plurality of second alignment grooves;

the plurality of second alignment grooves being centrally positioned on the second surface; and each of the plurality of second alignment grooves being positioned perpendicular to the longitudinal cavity.

8. The device for stamping on a belt as claimed in claim 1 comprises:

a plurality of first alignment grooves being positioned on the first surface;

each of the plurality of first alignment grooves being positioned perpendicular to the longitudinal cavity;

a plurality of second alignment grooves being positioned on the second surface; and each of the plurality of second alignment grooves being positioned perpendicular to the longitudinal cavity.

9. The device for stamping on a belt as claimed in claim 1, wherein the longitudinal cavity being positioned in parallel to the first rail and the second rail.

10. A device for stamping on a belt comprises:

a structural body;

a longitudinal cavity;

the structural body comprises a central panel, a first rail, and a second rail;

the central panel comprises a first surface, a second surface, a first lateral surface, and a second lateral surface;

the first rail and the second rail being adjacently connected to the second surface;

the first rail and the second rail being positioned perpendicular to the second surface;

the first rail and the second rail being positioned opposite each other across the central panel;

the longitudinal cavity perpendicularly traversing through the central panel from the first surface to the second surface;

the second surface, the first rail, and the second rail delineating a belt receiving channel;

the longitudinal cavity and the belt receiving channel being positioned in parallel to each other;

the first rail and the second rail being positioned along the central panel;

the first lateral surface and the second lateral surface being positioned opposite to each other along the central panel;

the first lateral surface and the second lateral surface being perpendicular to the first surface and the second surface;

the belt receiving channel having a first lateral opening adjacent to the first lateral surface and a second lateral opening adjacent to the second lateral surface;

at least one first alignment groove centrally positioned on the first surface and directly communicated with the longitudinal cavity;

at least one second alignment groove centrally positioned on the second surface and directly communicated with the longitudinal cavity; and the at least one first alignment groove and the at least one second alignment groove being aligned with each other.

11. The device for stamping on a belt as claimed in claim 10, wherein the belt receiving channel being extended from the first lateral surface to the second lateral surface.

12. The device for stamping on a belt as claimed in claim 10, wherein the longitudinal cavity being positioned in between the first lateral surface and the second lateral surface.

13. The device for stamping on a belt as claimed in claim 10, wherein the first rail is symmetrical to the second rail.

14. The device for stamping on a belt as claimed in claim 10 comprises:

a plurality of first alignment grooves;

the plurality of first alignment grooves being centrally positioned on the first surface; and each of the plurality of first alignment grooves being positioned perpendicular to the longitudinal cavity.

15. The device for stamping on a belt as claimed in claim 10 comprises:

a plurality of second alignment grooves;

the plurality of second alignment grooves being centrally positioned on the second surface; and each of the plurality of second alignment grooves being positioned perpendicular to the longitudinal cavity.

16. The device for stamping on a belt as claimed in claim 10 comprises:

a plurality of first alignment grooves being positioned on the first surface;

each of the plurality of first alignment grooves being positioned perpendicular to the longitudinal cavity;

a plurality of second alignment grooves being positioned on the second surface; and each of the plurality of second alignment grooves being positioned perpendicular to the longitudinal cavity.

17. The device for stamping on a belt as claimed in claim 10, wherein the longitudinal cavity being positioned in parallel to the first rail and the second rail.

* * * * *